US008596305B2

(12) United States Patent
Govindaswamy

(10) Patent No.: US 8,596,305 B2
(45) Date of Patent: Dec. 3, 2013

(54) METHOD OF WEAVING, PROCESSING AND FINISHING A PILE FABRIC

(76) Inventor: Kannappan Govindaswamy, Mettupalayam (IN)

( * ) Notice: Subject to any disclaimer, the term of this patent is extended or adjusted under 35 U.S.C. 154(b) by 25 days.

(21) Appl. No.: 13/525,426

(22) Filed: Jun. 18, 2012

(65) Prior Publication Data

US 2012/0247608 A1 Oct. 4, 2012

(30) Foreign Application Priority Data

Feb. 4, 2010 (IN) ..... 281/CHE/2010
Feb. 3, 2011 (WO) ..... PCT/IN2011/000081

(51) Int. Cl.
*D03D 27/04* (2006.01)
*D03D 15/06* (2006.01)

(52) U.S. Cl.
USPC .... 139/396; 139/383 R; 139/416; 139/420 R; 139/426 R

(58) Field of Classification Search
USPC ..... 139/383 R, 391–396, 402, 404, 416, 139/420 R, 426 R
See application file for complete search history.

(56) References Cited

U.S. PATENT DOCUMENTS 3,570,482 A * 3/1971 Emoto et al. ..... 602/76
3,837,946 A * 9/1974 Gribbin ..... 156/68
4,073,988 A * 2/1978 Nishida et al. ..... 428/91
4,146,663 A * 3/1979 Ikeda et al. ..... 428/96
4,228,829 A * 10/1980 Kikuchi ..... 139/408
4,290,766 A * 9/1981 Burns et al. ..... 8/491
RE31,601 E * 6/1984 Ikeda et al. ..... 428/93
4,482,594 A * 11/1984 Stousland ..... 428/92
4,546,020 A * 10/1985 Sakai et al. ..... 428/16
4,613,529 A * 9/1986 Yamashita et al. ..... 428/15
4,624,675 A * 11/1986 Irmer ..... 8/115.6
4,773,135 A * 9/1988 Sato et al. ..... 28/160
5,049,429 A * 9/1991 Shibukawa et al. ..... 428/88
5,380,574 A * 1/1995 Katoh et al. ..... 428/92
5,654,067 A * 8/1997 Dinger et al. ..... 428/95
5,680,826 A * 10/1997 Nagahama et al. ..... 112/410
6,494,925 B1 * 12/2002 Child et al. ..... 8/485
6,500,776 B2 * 12/2002 Hamada et al. ..... 442/192
7,192,895 B2 * 3/2007 Ito ..... 442/240
7,381,447 B2 * 6/2008 Hoersch ..... 427/365
7,543,608 B2 6/2009 Santens
7,741,234 B2 * 6/2010 Smith et al. ..... 442/381
2002/0124365 A1 * 9/2002 Wood et al. ..... 26/2 R
2003/0040809 A1 * 2/2003 Goldmann et al. ..... 623/23.76
2003/0051298 A1 * 3/2003 Child et al. ..... 8/494
2004/0128811 A1 7/2004 Mandawewala
2007/0264896 A1 * 11/2007 Smith et al. ..... 442/381

FOREIGN PATENT DOCUMENTS

CA 2102696 7/1991
CN 2420299 2/2001
CN 101671904 3/2010
JP 52055773 5/1977

* cited by examiner

*Primary Examiner* — Bobby Muromoto, Jr.
(74) *Attorney, Agent, or Firm* — Michael J. Feigin, Esq.; PatentLawNY.com Feigin & Associates, LLC

(57) ABSTRACT

Disclosed is a method of weaving, processing and finishing a pile fabric whose pile height (H) after processing and finishing is substantially increased, thus obtaining increased pile height (H) which may be multiple of the original pile height (H) of the woven fabric. Specifically, the pile fabric is manufactured with multiple loop heights combining the original woven pile heights and/or different multiples of the original pile heights. Further, a process results in a fabric having a combination of pile heights, and designs by weaving repeats in the conventional way without soluble yarns (Y) in conjunction with repeats woven with multiple soluble yarns (Y).

8 Claims, 3 Drawing Sheets

| | | | | | | | | | | | | |
|---|---|---|---|---|---|---|---|---|---|---|---|---|
| G1 | X | X | | X | X | | X | X | | X | X | |
| G2 | | | X | | | X | | | X | | | X |
| P1 | X | | X | X | | X | X | | X | X | | X |
| P2 | | X | | | X | | | X | | | X | |

G1 - Ground Warp 1
G2 - Ground Warp 2

P1- Pile Warp 1 ( Face Pile )
P2 - Pile Warp 2 ( Back pile)

| | | | | | | | | | | | | |
|---|---|---|---|---|---|---|---|---|---|---|---|---|
| G1 | X | X | | X | X | | X | X | | X | X | |
| G2 | | | X | | | X | | | X | | | X |
| P1 | X | | X | X | | X | X | | X | X | | X |
| P2 | | X | | | X | | | X | | | X | |

METHOD OF WEAVING, PROCESSING AND FINISHING A PILE FABRIC

FIELD OF INVENTION

The present invention relates to a method of weaving, processing and finishing a pile fabric, more specifically to a pile fabric whose pile height after processing and finishing is substantially increased to get an increased pile height which may be multiple folds of the original pile height of the woven fabric. Specifically the present invention also relates to the manufacture of pile fabric with multiple loop heights which are combinations of the original woven pile heights and (or) different multiple fold of the original pile heights. Further, the present invention discloses a process which results in a fabric having a combination of pile heights, and designs by weaving repeats in the conventional way without soluble yarn in conjunction with repeats woven with multiples of soluble yarn. Advantageously, the finished pile fabric of the present invention is particularly useful for making into towels of any size, for being made into garments that includes bathrobes, furnishing fabrics, industrial fabrics and technical fabrics.

DESCRIPTION OF PRIOR ART

Pile Fabrics (or) terry fabrics as they are generally known are woven with two warp beams, i.e., a ground warp beam and a pile warp beam and one set of weft fill yarns. Pile and ground yarns are interwoven with a set of weft yarns to form the fabric. Ground yarns are interwoven at high tension with the weft yarn to form the substrate of the fabric. The pile yarn are interwoven with the weft yarn at relatively much lower tension to form the pile loops which are projecting from the surface of the fabric usually on both the sides. The pile yarn is "let off" i.e., released from the pile beam at a much higher rate than the ground yarn is from the ground beam. When the released yarn is interwoven with the weft and "beat up" i.e. pushed closer together, the larger quantity of yarn released from the pile beam results in formation of loops.

Towels are generally used for the purpose of wiping things dry. Hence, they are designed to have more area of the pile yarn compared to the ground yarn and weft yarn. To provide more and more absorbent and luxurious towels the trend has been to increase the pile height of the terry to greater and greater levels.

In the manufacture of pile fabric, in order to maintain the quality of goods it is necessary to maintain the quantity and the tension of the pile-wrap yarn to be as constant as possible. Prior art techniques are imposed by the fact that variations in the ground-wrap tension affect the pre beating distance, which results in irregularities in the height of the pile.

U.S. Pat. No. 5,667,865, is a prior art patent titled "Terry fabric with increased rate of absorbency and method of forming same" which teaches about terry fabric and method of forming a terry fabric in which a ground fabric is formed of ground yarns while terry yarns are interlaced with the ground yarns to form terry loops with a height substantially greater than normal.

U.S. Pat. No. 5,771,943 is a prior art patent titled "Method and apparatus for the manufacture of carpet including an additional weft material" which discloses improvements in and relating to a method and apparatus for the manufacture of carpet and to a carpet manufactured thereby.

U.S. Pat. No. 7,762,286, is a prior art patent titled "Terry weave fabric" which deals with a terry fabric that includes a plurality of longitudinally-oriented ground warp yarns, a plurality of pile warp yarns in parallel with the ground warp yarns and a plurality of weft yarns oriented substantially laterally to the ground warp yarns US20050178458, is a prior art patent titled "Terry fabric and method for weaving same" which relates to a terry fabric comprising a plurality of repeat units of interwoven warp and weft threads. Each of the repeat units comprises a set of ground warp threads, a set of pile warp threads, and a set of weft threads.

CN21080533 is a prior art patent titled "High quality towel" which provides a towel for daily use, in particular to a high-loop-height-ratio towel made of regularly connected spiral terries characterized in that two semi-parts of each terry are mutually and spirally enlaced to form a super-long terry of each four-weft loop-raised weave.

CN11165246, is a prior art patent titled "Ultra-soft high water absorption hollow cotton towel and manufacturing method thereof" which describes the making process of very soft hydroscopic hollow cotton towel through spinning blended yarn with water soluble fiber and cotton, weaving, and dissolving the water soluble fiber in water.

CN1804174, is a prior art patent titled "Method for weaving fabric with Z-direction loop" which teaches Z-loop weaving method for fabric comprising the warping pretreatment, beaming, preparing for weave, weaving, splining, and shaping, using any one of the carbon fiber, pre-oxygen fiber, aramid fiber and glass fiber.

There has thus been a need in the art to manufacture pile fabrics whose pile height is increased compared to woven fabrics.

OBJECTS OF THE INVENTION

The primary object of the present invention is directed to the method of weaving, processing and finishing a pile fabric wherein the finished pile fabric possesses an increased pile height.

It is another object of the present invention to provide a pile fabric, wherein the yarn of the two (or) multiple piles Z combine to form a single pile whose length is double (or) Z times that of the original woven fabric.

It is another object of the present invention to provide a pile fabric, wherein the product possesses multiple loop heights.

It is another object of the present invention, wherein the product is woven using a multitude of multiple loop repeats of n pick terry fabrics.

It is another object of the present invention, wherein the product employing the pile yarn and the ground yarn are woven with variety of manmade or natural fibers.

It is another object of the present invention, wherein the product involves weaving multiple loop repeats in which, a number of picks (weft insertions) of the binding yarn are done using soluble yarns.

It is another object of the present invention to provide a process for manufacturing a pile fabric, wherein the pile fabric is formed by means of an n pick terry process.

It is another object of the present invention to provide a process for manufacturing a pile fabric, wherein the weft insertions of n pick terry fabric may use up to n different weft yarn material.

It is another object of the present invention to provide a process for manufacturing a pile fabric, wherein, the soluble weft yarns are dissolved using a solvent during processing of the pile fabric.

It is another object of the present invention to provide a process for manufacturing a pile fabric, wherein the preferred soluble yarn is Poly Vinyl Alcohol as it is easily soluble in water.

It is another object of the present invention to provide a process for manufacturing a pile fabric wherein, the yarn could be any other yarn which may be soluble in a solvent.

It is another object of the present invention to provide a process for manufacturing a pile fabric wherein, the binding weft yarn is dissolved causing the finished fabric to have double or many folds the loop height of the woven fabric.

It is another object of the present invention to provide a process for manufacturing a pile fabric, wherein the pile fabric is woven with a pile loop height of at least 1 mm up to a height equal to the maximum technological capability of a terry loom.

It is another object of the present invention to provide a process for manufacturing a pile fabric, wherein the process may be used to result in a fabric having a combination of pile heights, and designs by weaving repeats in the conventional way without soluble yarn in conjunction with repeats woven with multiples of soluble yarn.

It is another object of the present invention to provide a process for manufacturing a pile fabric, wherein the pile fabric finished after processing may be woven in a combination of regular pile fabric along with weaves in the similar manner of the present invention in a variety of possible combinations to form various design patterns.

It is another object of the present invention to provide a process for manufacturing a pile fabric, wherein the finished pile fabric of the present invention is particularly useful for making into towels of any size, for being made into garments that includes bathrobes, furnishing fabrics, industrial fabrics and technical fabrics.

It is another object of the present invention to provide a process for manufacturing a pile fabric, wherein the finished pile fabric may be used for producing blankets, rugs, and carpets etc.

The details of the invention, its object and advantages are explained hereunder is to be understood that the invention, as fully described herein is not intended to be limited by the objects mentioned herein.

SUMMARY OF INVENTION

Thus according to the basic aspect of the present invention there is provided a pile fabric comprising:

A plurality of ground warps yarns;

A plurality of pile warps yarns; and

A plurality of weft yarns, wherein one or more of the weft yarns is a soluble yarn, wherein the ground yarns are interwoven at high tension with the weft yarn to form the substrate of the fabric, wherein the pile yarns are interwoven with the weft yarn at lower tension to form the pile loops, wherein the pile loop projects from the surface of the fabric on both the sides, wherein the piles are formed using a multiple pick terry process, wherein multiple pile loops (Z) combine to form a single pile whose length is double (or) Z times that of the original woven fabric, and wherein the soluble weft yarns are dissolved using a solvent.

It is another aspect of the present invention, wherein the pile loop projection height is formed by the beat up length setting for the loose pile on the terry loom.

It is yet another aspect of the present invention, wherein multiple pile loops are formed using multitude of Z loop repeats of the multiple pick terry process.

It is another aspect of the present invention, wherein the pile fabric is woven with a pile loop height of at least 1 mm.

In another aspect of the present invention there is provided a pile fabric having a combination of pile heights and designs comprising:

A plurality of ground warps yarns;

A plurality of pile warps yarns; and

A plurality of weft yarns, wherein the yarns are woven in a known manner without soluble weft yarns in conjunction with repeats woven with multiples of soluble yarn.

In yet another aspect of the present invention there is provided a method of weaving, processing and finishing a pile fabric, the method comprising:

providing a plurality of ground warps yarns;

providing a plurality of pile warps yarns;

providing a plurality of weft yarns;

interweaving the ground yarns at high tension with the weft yarn to form the substrate of the fabric;

interweaving the pile yarns with the weft yarn at lower tension to form the pile loops; and processing the fabric woven using a solvent for the predetermined duration, at the predetermined temperature and at the predetermined liquor ratio to ensure complete dissolution of the soluble yarn, wherein one or more of the weft yarns is a soluble yarn, wherein the soluble weft yarns are dissolved using a solvent, wherein the pile loop projects from the surface of the fabric on both the sides, wherein the pile loops are formed using a multiple pick terry process, wherein during interweaving, the multiple pile loops (Z) combine to form a single pile whose length is double (or) Z times that of the original woven fabric, and wherein the finished pile fabric possesses an increased pile height.

It is further aspect of the present invention, wherein double or multiple folds (Z) of the pile height of the finished fabric are achieved by removing the binding between two or multiple consequent pile formations during processing of the fabric.

It is further aspect of the present invention, wherein during processing the fabric is washed using the solvent where the soluble yarn dissolves and releases the binding between the two or multiple consequent piles.

DETAILED DESCRIPTION OF THE INVENTION WITH REFERENCE TO THE ACCOMPANYING DRAWINGS

As stated above, the present invention is a process of weaving, processing and finishing a pile fabric which may be used to result in a fabric having a combination of pile heights, and designs by weaving repeats in the conventional way without soluble yarn in conjunction with repeats woven with multiples of soluble yarn.

According to the present invention a terry pile fabric comprising pile and ground yarns are interwoven with a set of weft yarns to form the fabric. The ground yarns are interwoven with high tension with the weft yarn to form the substrate and the pile yarns are interwoven with weft yarn with low tension to form the pile. The pile loop projects from the surface of the fabric on both the sides. The fabric is woven using a multitude of multiple loop repeats and multitudes of Z loop weaving repeats of n pick terry fabrics. It involves a number of picks (weft insertions), of which the binding pick yarn of the multiple loop repeats are woven using soluble yarns.

The pile yarn and the ground yarn include any variety of man made or natural fibers. The weft insertions of n pick terry fabric may use up to n different weft yarn material. The soluble weft yarns are dissolved during processing of the pile fabric. This causes the finished fabric to have double or many folds the loop height of the woven fabric. The other weft yarns may be made of cotton or other natural/manmade yarns.

Figure 1:
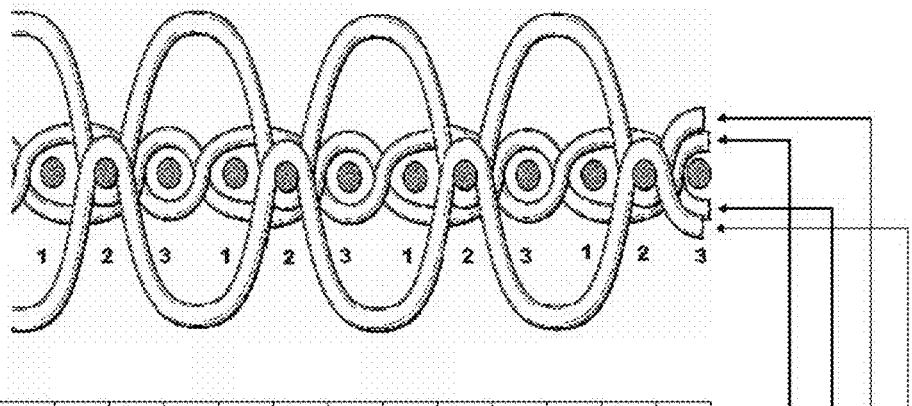
FIG. 1: Illustrates 2 sequential pile formations in a standard 3 pick terry pile fabric.

Reference is now invited to accompanying FIG. 1 that illustrates 2 sequential pile formations in a standard 3 pick terry pile fabric. The invention accomplishes a double or multiple folds (Z) of the pile height of the finished fabric compared to that of the woven fabric. The (n−1) pick of the second/second to Z, n pick terry fabric of a Z pile sequence are woven using a soluble yarn material.

Figure 2:
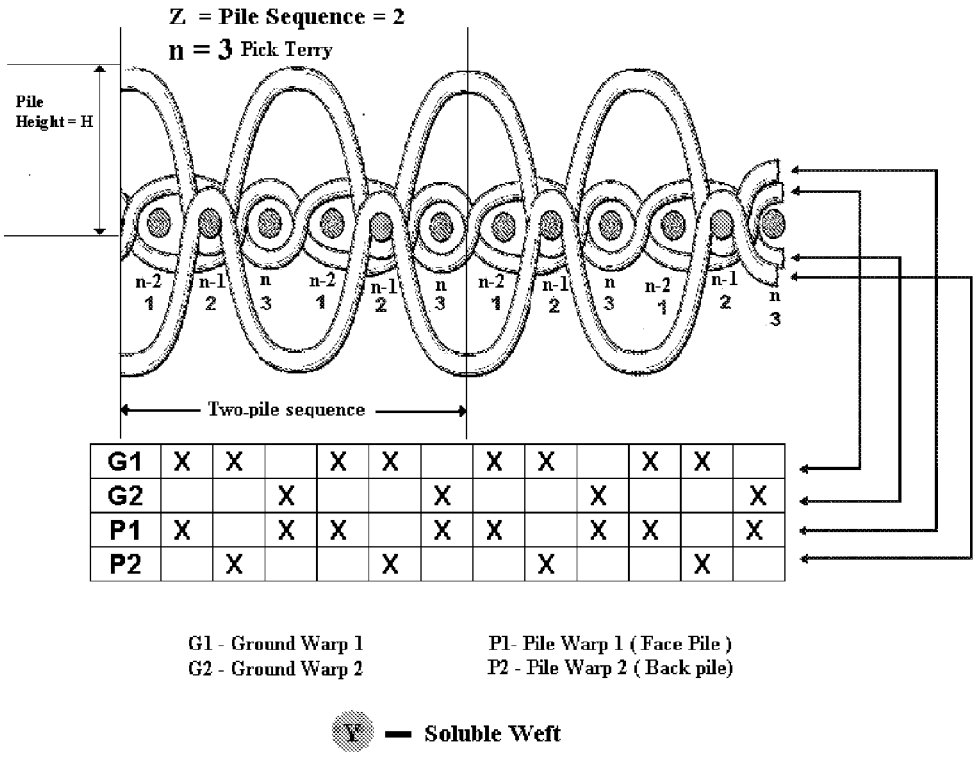
FIG. 2: Illustrates the invention with the 3 weft insertions with soluble material in two sequential pile formations of a 3 pick terry pile fabric.

The present invention is done using a fabric woven with a n pick terry for example n=3 and will hold good for all n pick terry fabrics as shown in FIG. 2. The desired double or multifold pile height to be achieved is denoted by Z, where Z is the number of multifold of the pile height increase that is desired in the finished fabric from the woven pile height H.

Other formats such as n pick terry are also feasible where n=4, 5, 6, etc., where the loop is formed once every n picks. In every case the pile loops if formed during the nth pick insertion and is bound in place between the nth and the (n−1) pick. The n pick terry formation is repeated and the next pile is also formed and so on to form the terry fabric. The invention thus accomplishes a double or multiple folds (Z) of the pile height of the finished fabric compared to that of the woven fabric by removing the binding between two or multiple consequent pile formations during processing of the fabric. This is achieved when the (n−1) pick of the second/second to Z, n pick terry fabric of a Z pile sequence are woven using a yarn material which is soluble in a certain solvent during processing whereas all the other yarns are not soluble. After the weaving process is completed the fabric thus woven is then processed using a solvent S for the required duration, at the required temperature and the at the required liquor ratio to ensure complete dissolution of the soluble yarn Y. During processing, soluble yarn Y dissolves and releases the binding between the two or multiple consequent piles. The yarn of the two (or) multiple piles Z thus combine to form a single pile whose length is double (or) Z times that of the original woven fabric. The liquor ratio is defined as the ratio of the weight of the liquid in which the fabric is being processed to the weight of the fabric.

The binding pick weft yarn material of the second/second to Z loop/loops of the Z terry repeats is/are woven using soluble yarn Y as shown in FIG. 2. Poly Vinyl Alcohol is preferred as the soluble yarn as it is easily soluble in water. However the yarn could be any other yarn which may be soluble in a solvent. All/some of the other yarns may be woven using any other material which is not soluble in the solvent S of the soluble yarn Y.

In a preferred embodiment, at least two different weft yarns are used to weave the terry fabric wherein at least one of the weft yarns Y is dissolvable in the solvent S. All the other weft yarns other than Y are not soluble in the solvent S.

Figure 3:
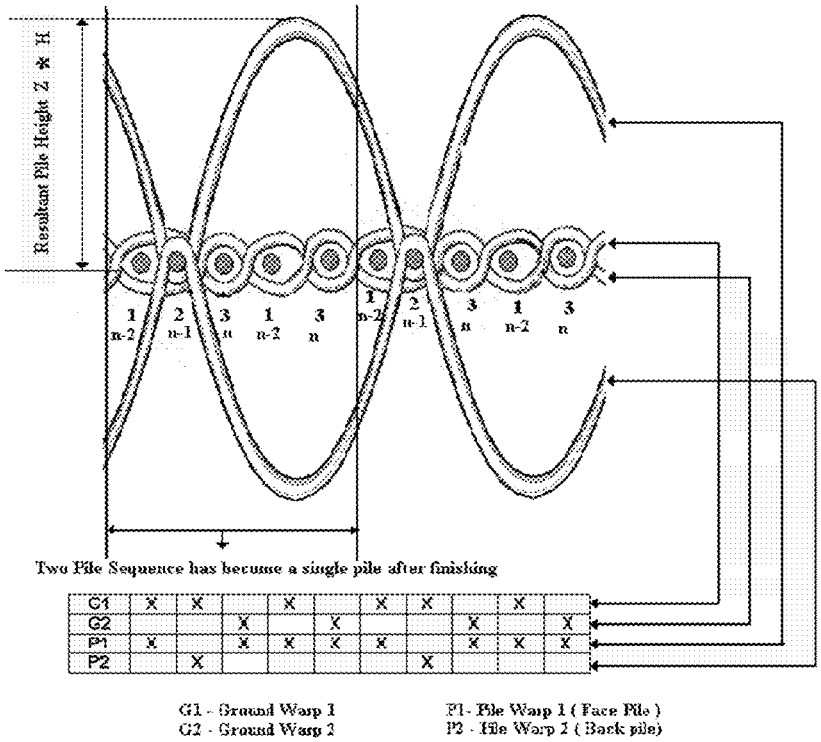
FIG. 3: Illustrates the fabric shown in FIG. 1 after the soluble yarn is dissolved and the pile height is doubled.

Reference is now made to FIG. 3 illustrating the fabric shown in FIG. 1 after the soluble yarn is dissolved and the pile height is doubled. The cross-section of the pile fabric shows that the soluble yarn Y in the $2^{nd}$ (n−1, where n=3) pick of the $2^{nd}$ (Z) consequent 3 pick terry pile fabric repeat of a 2 (Z) pile sequence has been dissolved. The FIG. 3 thus shows that after finishing the process, the two pile sequences has become a single pile with the resultant pile height denoted as Z*H.

The pile height of the fabric during weaving is at least 1 mm and can be woven up to the maximum height equivalent to the technological capability of terry machines. The pile height is formed by the beat up length setting for the loose pile on the terry loom. The pile height is approximately equal to half the beat up length.

The pile fabric finished after processing may be woven in a combination of regular pile fabric along with weaves in the similar manner of the present invention in a variety of possible combinations to form various design patterns.

The pile fabric of the present invention is particularly useful for making into towels of any size, for being made into garments such as bathrobes, furnishing fabrics, industrial fabrics and technical fabrics. The pile fabric may be used for producing Blankets, Rugs, Carpets etc.

Some specific examples of a pile fabric according to the present invention are provided below:

| | |
|---|---|
| Fabric Weave: | 3 pick terry weave |
| Pile Yarn: | Cotton yarn consisting of 100% cotton of yarn count 20/2 Ne |
| Ground Warp: | Cotton yarn of count 10 Ne |
| Weft yarn (non soluble): | Cotton Yarn of count 10 Ne |
| Weft yarn (soluble): | Poly Vinyl Alcohol of count 30 Ne |

Specification of Woven Fabric:

| | |
|---|---|
| Ends per cm: | 24 |
| Weft picks per cm: | 16 |
| Pile ratio: | 10:65 |
| Pile Height: | 6 mm |
| Weight/M^2: | 640 grams |

Specification of Finished Fabric:

| | |
|---|---|
| Ends per cm: | 27.4 |
| Weft picks per cm: | 14 |
| Pile ratio: | 10:65 |
| Pile Height: | 12 mm |
| Weight/M^2: | 692 grams |

The above examples provide representations of the effectiveness of some preferred specifications within the scope of the present invention. The present invention may be embodied in other specific forms without departing from its spirit or essential characteristics. The described embodiments are to be considered in all respects only as illustrative and not restrictive.

The invention claimed is:

1. A pile fabric comprising:

A plurality of ground warps yarns;

A plurality of pile warps yarns; and

A plurality of weft yarns, wherein one or more of the weft yarns is a soluble yarn, wherein the ground yarns are interwoven at high tension with the weft yarn to form the substrate of the fabric, wherein the pile yarns are interwoven with the weft yarn at lower tension to form the pile loops, wherein the pile loop projects from the surface of the fabric on both the sides, wherein the piles are formed using a multiple pick terry process, wherein multiple pile loops (Z) combine to form a single pile whose length is double (or) Z times that of the original woven fabric, and wherein the soluble weft yarns are dissolved using a solvent.

2. The pile fabric as claimed in claim 1, wherein the pile loop projection height is formed by the beat up length setting for the loose pile on the terry loom.

3. The pile fabric as claimed in claim 1, wherein multiple pile loops are formed using multitude of Z loop repeats of the multiple pick terry process.

4. The pile fabric as claimed in claim 1, wherein the pile fabric is woven with a pile loop height of at least 1 mm.

5. The pile fabric as claimed in claim 1, having a combination of pile heights and designs comprising:

A plurality of ground warps yarns;

A plurality of pile warps yarns; and

A plurality of weft yarns, wherein the yarns are woven in a known manner without soluble weft yarns in conjunction with repeats woven with multiples of soluble yarn.

6. A method of weaving, processing and finishing a pile fabric as claimed in claim 5, the method comprising:

providing a plurality of ground warps yarns;

providing a plurality of pile warps yarns;

providing a plurality of weft yarns;

interweaving the ground yarns at high tension with the weft yarn to form the substrate of the fabric;

interweaving the pile yarns with the weft yarn at lower tension to form the pile loops; and processing the fabric woven using a solvent for the predetermined duration, at the predetermined temperature and at the predetermined liquor ratio to ensure complete dissolution of the soluble yarn, wherein one or more of the weft yarns is a soluble yarn, wherein the soluble weft yarns are dissolved using a solvent, wherein the pile loop projects from the surface of the fabric on both the sides, wherein the pile loops are formed using a multiple pick terry process, wherein during interweaving, the multiple pile loops (Z) combine to form a single pile whose length is double (or) Z times that of the original woven fabric, and wherein the finished pile fabric possesses an increased pile height.

7. The method as claimed in claim 6, wherein double or multiple folds (Z) of the pile height of the finished fabric is achieved by removing the binding between two or multiple consequent pile formations during processing of the fabric.

8. The method as claimed in claim 7, wherein during processing the fabric is washed using the solvent where the soluble yarn dissolves and releases the binding between the two or multiple consequent piles.

* * * * *